United States Patent [19]

Gallatin

[11] 4,095,200

[45] June 13, 1978

[54] CONTACTOR HAVING REDUCED CONTACT BOUNCE AND SHORTER ARC TIME

[75] Inventor: Paul M. Gallatin, Brookfield, Wis.

[73] Assignee: Allis-Chalmers Corporation, Milwaukee, Wis.

[21] Appl. No.: 753,310

[22] Filed: Dec. 22, 1976

[51] Int. Cl.[2] ..... H01H 3/60

[52] U.S. Cl. ..... 335/193; 335/194

[58] Field of Search ..... 335/193, 192, 194, 46, 335/271, 104, 247, 248, 156, 157, 158; 200/288

[56] References Cited

U.S. PATENT DOCUMENTS 2,932,704 4/1960 Dennison et al. ..... 335/192

*Primary Examiner*—Harold Broome

*Attorney, Agent, or Firm*—Lee H. Kaiser

[57] ABSTRACT

A DC contactor providing increased magnetic efficiency, reduced contact bounce, and shorter arc time has a movable contact carrier bar pivotally mounted relative to a clapper armature so as to prevent tilting about its longitudinal axis and eliminate rotational bounce; a pre-loaded contact pressure spring which resiliently urges the contact carrier bar against the armature; an armature retainer spring which resiliently urges the pivoted end of the armature backward and downward against the yoke so as to displace dirt accumulated in the pivot area and prevent jamming of the armature; a generally hyperbolic magnetic pull characteristic with the knee at approximately the one-half armature travel position and the magnetic pull at the two-thirds armature travel position being approximately twice the magnetic pull at the knee to thus provide relatively high magnetic pull per ampere in the region above the knee; the magnet gap between armature and core at the point of contact engagement being less than that at the knee of the characteristic so that the force of the pre-loaded contact pressure spring tending to reduce contact bounce can be greater than the magnetic pull at the knee and also several times greater than the force of the return spring at the contact touch point, and the total return spring and contact pressure spring forces can be increased to overcome residual mmf and accelerate the contacts to open position at a higher separation rate.

8 Claims, 8 Drawing Figures

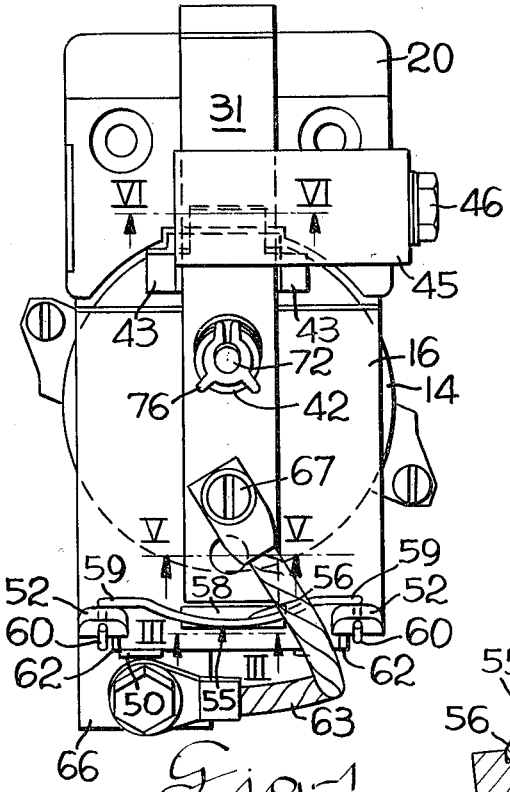
Fig. 1
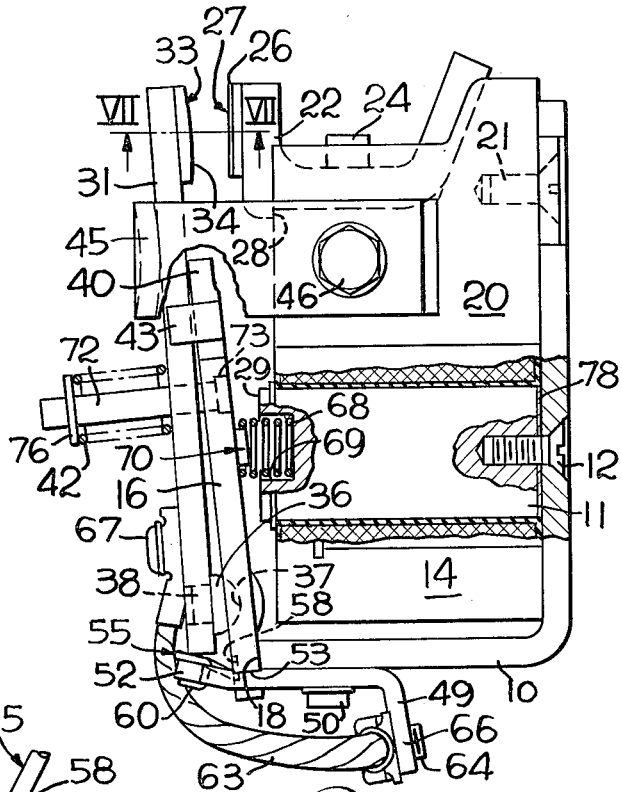
Fig. 2
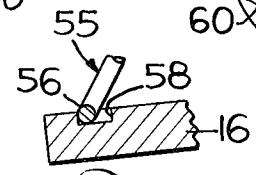
Fig. 4
Fig. 7
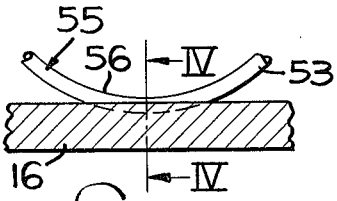
Fig. 3
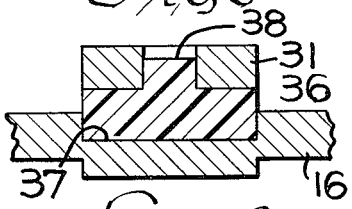
Fig. 5
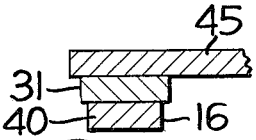
Fig. 6
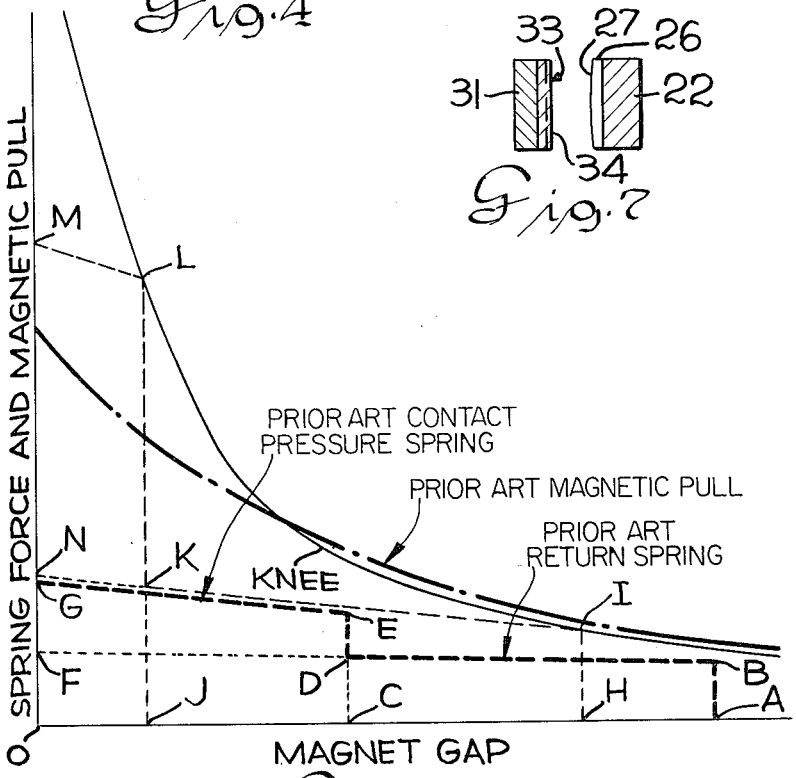
Fig. 8

CONTACTOR HAVING REDUCED CONTACT BOUNCE AND SHORTER ARC TIME

This invention relates to electric contact devices and more particularly to electromagnetically actuated circuit controlling devices such as contactors.

BACKGROUND OF THE INVENTION

The movable contact of an electromagnetically actuated circuit controlling device such as a DC contactor is pulled at high velocity into engagement with a rigid stationary contact when the armature is attracted to the magnetic core, and the movable contact tends to rebound when it strikes the rigid stationary contact. The consequent bouncing of the parts when the movable contact is stopped suddenly causes arcing which produces wear and erosion of the contacts and renders the circuit controlling action of the device uncertain. The erosion of the contacts due to such arcing results in a decrease in contact pressure with a consequent increase in contact resistance and in heating of the contacts and may eventually cause contact welding. I have also found that accumulation of falling dirt and dust in the armature pivot area may mechanically jam the armature and cause its pivoted end to move in a direction away from the yoke rather than pivoting in line engagement with the yoke. Further, the movable contact carrier bar of certain prior art contactors was permitted to tilt about its longitudinal axis relative to the armature for the purpose of providing wiping action between the contacts, and it has been found that such tilting motion of the movable contact carrier bar resulted in "rotational bounce" when the movable contact struck the rigid stationary contact which contributed to contact-bounce, and thus to contact welding, and also caused a tapered wear pattern on the contacts which prevented use of full volume of the silver contact material.

In order to reduce rebound of the movable parts, it is known to provide a pre-loaded contact pressure spring which biases the movable contact carrier toward the armature so they move as a unit until the movable contact engages the stationary contact, after which the armature continues to travel so that the force of the pre-loaded contact pressure spring is applied against the movable contact carrier to effect high contact pressure and thus reduce contact bounce. Other known arrangements utilize an inertia weight which additionally compresses the contact pressure spring when the armature closes in an attempt to prevent the contacts from bouncing. As far as I am aware, such prior art arrangements do not provide maximum magnetic efficiency, i.e., maximum pull per ampere, and have relatively low contact pressure spring force with the result that they are relatively ineffective in preventing contact bounce with consequent contact welding when high magnitudes of current flow through the contacts. Specifically, I have found that typical prior art contactors have magnetic circuits with relatively low reluctance in the open armature position but relatively high reluctance in the magnet gap region adjacent the closed armature position and, further, that the magnet gap in such prior art contactors at the point of contact engagement is greater than the magnet gap at the knee of the generally hyperbolic magnetic pull characteristic. As a result the characteristic has a relatively gradual slope above the knee; the flux density (and thus magnetic pull per ampere) is limited in such prior art contactors by the relatively high reluctance in this magnetic gap region above the knee; the combined force of return spring and contact pressure spring in the closed armature position tending to overcome the residual mmf and accelerate the armature and contacts to open position is similarly limited; and also the force of the pre-loaded contact pressure spring (which reduces contact bounce) must be less than the magnetic pull at the knee and also less than that of the return spring because of the magnet gap at the point of contact engagement.

OBJECTS OF THE INVENTION

It is an object of the invention to provide an improved electromagnetically actuated circuit controlling device which, in comparison to prior art devices, substantially reduces contact bounce and shortens arc time.

Another object of the invention is to provide such an improved electromagnetically actuated circuit controlling device which, in comparison to prior art devices, has increased magnetic efficiency and increased contact pressure tending to reduce contact bounce.

A further object is to provide such an improved electromagnetically actuated circuit controlling device wherein, in comparison to prior art devices, the force of the pre-loaded contact pressure spring tending to reduce contact bounce is substantially increased and also the total spring force available in the closed armature position to overcome the residual mmf and to accelerate the armature and contacts to open position is materially increased.

A still further object is to provide an improved DC contactor wherein, in comparison to prior art devices, the contact separation rate is materially augmented and the arc time is materially shortened.

A particular object is to provide an improved electromagnetically actuated circuit controlling device wherein all magnetic and resilient forces are exerted in a common plane in which the armature moves and the contacts have point engagement and wherein rotational bounce of the movable contact is eliminated.

Still another object is to provide such an improved electromagnetically actuated circuit controlling device which prevents accumulation of dirt in the armature pivot area where it might jam the armature.

DESCRIPTION OF THE DRAWINGS

The above and other objects and advantages of the invention will be more readily apparent from the following detailed description when considered together with the accompanying drawings wherein:

FIG. 1 is a front view of a DC contactor embodying the invention;

FIG. 2 is a side view of the contactor shown in FIG. 1;

FIGS. 3, 5 and 6 are views taken respectively along lines III—III, V—V and VI—VI of FIG. 1;

FIG. 4 is a view taken along lines IV—IV of FIG. 3;

FIG. 7 is a view taken along lines VII—VII of FIG. 2; and

FIG. 8 is a graph plotting magnetic pull on the armature and spring force as ordinates against armature gap as abscissae respectively for a typical prior art contactor (in heavy lines) and for a contactor embodying the invention (in light lines); the contact pressure spring force curves (DEG for prior art and KLM for present invention) being plotted with zero value at the magnitude of return spring force at the point of contact engagement.

SUMMARY OF THE INVENTION

An electromagnetically actuated circuit controlling device embodying the invention provides increased magnetic efficiency, reduced contact bounce and shorter arc time in comparison to prior art devices and has a movable contact carrier bar pivotally mounted relative to the armature and resiliently urged by a pre-loaded contact pressure spring against the armature, the magnet gap at the point of contact engagement being less than that at the knee of the generally hyperbolic magnetic pull curve so that the force of the pre-loaded contact pressure spring tending to prevent contact bounce can be greater than the magnetic pull at the knee of the characteristic and can also be substantially greater than the force of the return spring at the point where the contacts touch. The reluctance of the contactor magnetic circuit in the magnet gap region above the knee of the hyperbolic magnetic pull characteristic is preferably reduced in comparison to prior art devices in order to provide higher magnetic pull per ampere in this region and effect a characteristic having the knee approximately at the one-half armature travel position and a magnetic pull at the one-third armature travel position which is greater than 150% of the magnetic pull at the knee. Such structure permits increase of the contact pressure spring force opposing contact bounce and also permits increase of the combined return spring and contact pressure spring forces tending to overcome residual mmf and to accelerate the armature and contacts to open position, with the result that the contact separation rate is augmented and contact arc time is shortened. Preferably, the magnetic pull at the one-third armature travel point is greater than 200% of the magnetic pull at the knee, the contacts engage at a magnet gap which is less than the magnet gap at the one-third armature travel point, and the contact pressure spring is pre-loaded to a force greater than twice the magnetic pull at the knee.

In a preferred embodiment, an armature retainer spring resiliently urges the pivoted end of the armature both backward and downward against the yoke so that pivoting of the armature displaces accumulated dirt away from the armature pivot area and prevents jamming of the armature.

DETAILED DESCRIPTION

Referring to the drawing, the invention is illustrated as embodied in an electromagnetically actuated circuit controlling DC contactor having an L-shaped magnetic yoke 10, a cylindrical magnetic core 11 affixed to yoke 10 by a nonmagnetic screw 12, an energizing coil 14 surrounding core 11, and a clapper type magnetic armature 16 mounted in line engagement with a straight edge 18 of yoke 10 for pivotal movement relative to yoke 10. Although the contactor is shown in FIGS. 1 and 2 in its normally mounted position with armature 16 in a vertical plane, the contactor structure will be described as though the longer leg of L-shaped yoke 10 is adjacent the "lower" end and the stationary contact is at the "front" of the contactor.

A stationary contact insulating block 20 may be secured to yoke 10 by a screw 21. A rigid stationary contact 22 of high conductivity metal such as copper plated with silver may be secured to block 20 by a bolt 24. A silver contact button 26 may be brazed to stationary contact 22, and button 26 preferably has a cylindrical upper face 27 (see FIG. 7) whose axis is in the plane of movement of armature 16. Stationary contact 22 has a shoulder 28 which abuts a surface of insulating block 20 so that contact button 26 is guided from block 20 and is thus accurately located relative to yoke edge 18 and to the surface 29 of core 11 which engages armature 16.

A movable contact carrier bar 31 of high conductivity metal such as copper plated with silver is carried by armature 16 and moves as a unit with armature 16 during closing until the point at which the contacts engage. Bar 31 carries a silver contact button 33 having a cylindrical surface 34 (see FIG. 2) whose axis lies in a transverse plane through the contactor and which has point engagement with cylindrical surface 27 of stationary contact button 26 in the plane of armature movement when armature 30 is attracted to core 11.

The two cylindrical contact faces 27 and 34 arranged at 90° to each other provide point engagement in the plane of the center of the moving masses and contribute to prevention of rocking of contact carrier bar 31 about its longitudinal axis relative to armature 16. Relative pivotal movement between armature 16 and contact carrier bar 31 is afforded by a cylindrical pivot bearing 36 affixed to bar 31 which fits within a complementary depression 37 in armature 16 (see FIG. 5). Pivot bearing 36 is preferably of a filled polytetrafluoroethylene material having long wearing qualities and is provided with a transverse stem 38 (see FIG. 5) which fits within an aperture in bar 31. A contact bar-engaging projection 40 on armature 16 normally engages the flat lower surface of contact carrier bar 31 (see FIG. 6). The movable contact carrier bar 31 is prevented from tilting, or rocking, about its longitudinal axis relative to armature 16 by: (1) the line engagement of cylindrical pivot bearing 36 within the complementary cylindrical depression 37 adjacent the pivoted end of armature 16, (2) the engagement of straight bar-engaging projection 40 of armature 16 with the flat lower surface of contact carrier bar 31 shown in FIG. 5, (3) pre-loaded contact pressure spring 42 which resiliently biases bar 31 and armature 16 together; and (4) the above-described cylindrical contact surfaces 27 and 34 which are perpendicular to each other and meet in point engagement in the plane of movement of armature 16. Such means to prevent tilting of contact carrier bar 16 about its longitudinal axis eliminates rotational bounce with consequent reduction in erosion of the contacts and also assures that all magnetic and resilient forces are exerted in said single plane.

Upstanding ears 43 on opposite sides of armature 16 adjacent bar-engaging projection 40 guide and limit lateral movement of bar 31 relative to armature 16. An L-shaped limit stop 45 affixed to stationary contact block 20 by a bolt 46 is in interfering relation with bar 31 and limits travel of armature 16 in the opening direction. It will be appreciated that in alternative embodiments limit stop 45 may carry a stationary contact button (not shown) which cooperates with a movable contact button (not shown) on the upper surface of bar 31 to define a pair of normally closed contacts.

An armature retainer 49 affixed to yoke 10 by screws 50 has a pair of spaced apart upwardly extending ears 52 disposed on opposite sides of the pivoted end of armature 16. Armature 16 is provided with shoulders 53 which abut against ears 52 to prevent translation of armature 16 in a longitudinal rearward direction. A generally horn-shaped armature retainer spring 55 is affixed to retainer 49 and resiliently biases the pivoted end of armature 16 downward toward edge 18 and to the rear against retainer 49 and resiliently urges armature 16 to pivot in line engagement with yoke edge 18, rather than moving in a direction away from edge 18 when armature 16 is attracted to core 11. This arrangement displaces accumulated dirt away from the pivot area when armature 16 pivots and prevents jamming of the armature. The bight 56 of spring 55 is disposed in a groove 58 (see FIG. 4) formed in armature 16 near the tail end thereof, and the spring arm portions 59 on both sides of bight 56 extend upwardly and outwardly so as to be disposed in front of retainer ears 52. The arm portions 59 of spring 55 terminate in rearwardly bent hook portions 60 which embrace laterally inward extending projections 62 on retainer 49.

One end of a flexible conductor 63 may be secured by a bolt 64 to a rearwardly extending terminal portion 66 on armature retainer 49, and the other end of conductor 63 may be secured to movable contact carrier bar 31 by a screw 67.

One end of a pre-loaded helical compression return spring 68 may be disposed in an axial opening 69 in core 11 and the other end may surround a button projection 70 on the lower surface of armature 16 so that the axis of spring 68 is in the common plane in which the contacts engage and so that armature 16 is resiliently biased toward open position by return spring 68.

A guide pin 72 has a head 73 disposed beneath the lower surface of armature 16 and extends upwardly through clearance holes in armature 16 and in movable contact carrier 31. Pre-loaded helical, compression, contact pressure spring 42 surrounds guide pin 72 so that its axis is in said common plane, and a snap ring 76 fits within a circumferential groove in pin 72 and holds spring 42 in pre-loaded condition so that it urges movable contact carrier bar 31 toward armature 16.

A thin shim 78 (e.g., 0.002 inch thick) of suitable non-magnetic material such as stainless steel is disposed between yoke 10 and core 11 so that it is in the closed magnetic path and tends to prevent the armature 16 from freezing to the core 11 as a result of residual mmf when coil 14 is de-energized.

I have found that contact welding in prior art devices is at least partially attributable to the fact that neither maximum magnetic efficiency nor maximum contact pressure spring force for a given number of coil ampere turns are attained, with the result that considerable contact bounce occurs in prior art devices when the movable contact strikes the rigid stationary contact and also optimum spring force is not available in closed armature position to overcome residual mmf and to accelerate the contacts to open position. FIG. 8 illustrates the magnetic pull and spring force curves for a typical prior art contactor respectively in heavy dash-dot lines and heavy dashed lines and also illustrates in light full lines and light dashed lines respectively: (a) the magnetic pull and (b) the spring force (HIKN for return spring and KLM for contact pressure spring) curves for a contactor embodying the invention having the same rating and whose coil is energized with the same number of ampere turns as the prior art device. Magnet gap (e.g., between core 11 and armature 16) in inches is plotted as abscissae against magnetic pull and spring force on the armature in pounds as ordinates. The contact pressure spring force curve (DEG for prior art and KLM for present invention) is plotted "above" the return spring force curve (ABDF for prior art and HIKN for present invention) so that zero contact pressure spring force is approximately at the magnitude of return spring force at the point where the contacts engage, as described hereinafter. Such plotting of the spring force curves facilitates illustration of total resilient forces and total potential spring energy available to actuate the armature and contacts to open position.

It will be appreciated that the area under the magnetic pull characteristic represents the energy available to actuate the armature to closed position against the forces of the return spring and the contact pressure spring and also that the area under both the return spring and contact pressure spring force curves represents the potential energy available to actuate the armature and contacts to open position when the coil is de-energized. In both contactors a limit stop such as 45 holds the armature such as 16 in an initial open position wherein the return spring such as 68 is pre-loaded and opposes armature closing, and the magnetic pull on the armature should exceed the force of the pre-loaded return spring in order to attract the armature. For the prior art contactor, the initial armature position magnet gap (when bar 31 engages limit stop 45) is represented by OA; the initial force of the pre-loaded return spring 68 is represented by ordinate AB; and the magnet gap at the contact engagement point is represented by OC. The force of the return spring increases along line BD, whose slope is dependent upon the spring stiffness constant, from magnitude AB at the open armature position to the magnitude represented by ordinate CD at the contact engagement point. After the contacts engage, further travel of the armature is also opposed by the force (represented by ordinate DE) of the pre-loaded contact pressure spring. In order to effect further armature travel, the magnetic pull on the armature plus the force due to its kinetic energy must exceed the combined force of the return spring (CD) plus the force of the pre-loaded contact pressure spring (DE). The force of the contact pressure spring increases during armature overtravel along line EG, and at the closed armature position the maximum force of the contact pressure spring is represented by FG and that of the return spring by OF. However, contact bounce occurs primarily at contact engagement, and only the force DE of the pre-loaded contact pressure spring is available to prevent contact bar 31 from rebounding in such typical prior art contactor and such force must be less than the magnetic pull at the knee because the magnet gap at the knee is less than that at the contact touch point. Further, at the closed armature, or seal, position, the combined force OF of the return spring plus the force FG of the contact pressure spring is available to overcome residual mmf and to accelerate the armature and contacts to open position. Also at the closed armature position, the potential spring energy available to open the armature is represented by the area OABDEGO which, it will be appreciated, includes the area under both the return spring force curve plus the area under the contact pressure spring force curve (minus an area equal to contact touch gap OJ times initial contact pressure spring force JK).

In accordance with the invention, the armature-engaging surface 29 of core 11 in the contactor embodying the invention is so positioned relative to stationary contact 26 that the magnet gap (OJ) at the point where the contacts 26, 33 engage is less than the magnet gap at the knee of the generally hyperbolic magnetic pull curve. This permits the force (KL) of the pre-loaded contact pressure spring (which opposes contact bounce) to be greater than the magnetic pull at the knee and also to be substantially greater than the return spring force JK at the contact engagement point OJ where contact bounce primarily occurs. In fact, the force KL of the pre-loaded contact pressure spring 42 tending to prevent rebound of contact carrier bar 31 is greater than 200% of the force JK of the return spring 68 at the point of contact engagement; greater than 160% of the magnetic pull at the knee; and also greater than 600% of the force DE of the contact pressure spring of the prior art contactor. The disclosed contactor embodying my invention also provides higher magnetic pull in the magnet gap region above to the knee of the generally hyperbolic magnetic pull curve so that magnetic efficiency is increased and also so that increased total spring force is available to overcome residual mmf.

I have found that magnetic efficiency (i.e., magnetic pull per ampere turn) is not optimum in typical prior art contactors, primarily because their magnetic circuits have a relatively low reluctance in the open armature position but a relatively high reluctance adjacent the closed armature position, thereby undesirably lowering magnetic flux density and magnetic pull (which is proportional to $B^2A$), in the region above the knee of the pull characteristic.

In accordance with the invention, the reluctance of the contactor magnetic circuit is relatively low when the armature is adjacent the seal position, thereby increasing the magnetic flux density and the magnetic pull in the magnet gap region above the knee. Such structure effects a magnetic pull characteristic (shown in light lines in FIG. 8) which is below that of the prior art contactor below the knee and materially higher than that of the prior art contactor above the knee and wherein the knee occurs approximately at the one-half armature travel position (where the magnet gap is equal to one-half that of the initial gap when contact bar 31 engages stop 45) and the portion of the characteristic above the knee has a relatively steep slope with a magnetic pull at the one-third armature travel position greater than 150% of that at the knee and preferably greater than 200% of the magnetic pull at the knee. In a preferred embodiment the magnet gap at the contact touch point (OJ) is less than the magnet gap at the one-third armature travel position and the force (KL) of the pre-loaded contact pressure spring opposing contact bounce is greater than 160% of the magnetic pull at the knee. The higher magnetic pull in the magnet gap region above the knee of the characteristic results in higher magnetic pull per ampere and higher contact pressure in the armature seal position and permits increase of the contact pressure spring force (KL) tending to oppose contact bounce as well as the combined force (OM) of the return and contact pressure springs tending to overcome residual mmf and to accelerate the armature and contacts to open position. The increased magnetic pull also provides higher pressure between contacts 26 and 33 with consequent reduction in contact resistance and in voltage drop between these contacts. The greater magnetic pull on the armature is exerted for the interval of time from contact touch to armature seal, and such greater force can absorb kinetic bounce energy faster than in prior art contactors and this reduces contact bounce.

At the contact touch point (J), the magnetic pull on the armature 16 plus the force due to its kinetic energy moves the armature to closed position against the combined force of the return spring (JK) plus the force (KL) of the contact pressure spring 42. The contact pressure spring force increases, as the armature travels toward seal position, along line LM whose slope is dependent upon the spring stiffness constant, and similarly the return spring force increases along line KN. At contact touch, the relatively high contact pressure spring force KL opposes contact bounce. At the armature seal position, the force ON of the return spring 68 plus the force NM of the contact pressure spring 42 is available to overcome the residual mmf, and it will be appreciated that such combined spring force OM is substantially greater than the combined spring force OG of the prior art contactor. Also the potential spring energy represented by the area OHIKLMO is available to actuate the armature to open position, and it will be appreciated that such potential spring energy is substantially greater than the armature-opening potential spring energy of the prior art contactor represented by the area OABDEGO. Such greater total spring force OM and greater spring potential energy rapidly accelerates armature 16 during opening before it strikes contact carrier bar 31 so that the separation rate of contacts 33 and 26 is materially augmented and the time of arcing therebetween is substantially reduced in comparison to prior art devices.

I have found that the contact bounce time of typical prior art contactors was approximately 8 to 18 milliseconds and that such contact bounce time has been reduced to between zero and 2 milliseconds in the disclosed contactor embodying my invention.

While only a single embodiment of my invention has been illustrated and described, many modifications and variations thereof will be readily apparent to those skilled in the art, and consequently it should be understood that I do not intend to be limited to the particular embodiment shown and described.

The embodiments of the invention in which an exclusive property or privilege is claimed are defined as follows:

1. A DC contactor having reduced contact bounce and shorter arc time comprising, in combination, a magnetic yoke, a magnetic core affixed to said yoke, an energizing coil surrounding said core, a magnetic armature pivotally mounted on said yoke and forming a closed magnetic circuit together with said yoke and said core, a contact carrier bar, a stationary contact, a movable contact affixed to said contact carrier bar and cooperating with said stationary contact, return spring means for resiliently urging said armature to open position, said contact carrier bar being carried on said armature so that they move together during armature closing until said movable and stationary contacts engage and being pivotable relative to said armature during further travel of said armature, pre-loaded contact pressure spring means for urging said contact carrier bar toward said armature, and stop means in interfering relation with said contact carrier bar for limiting opening movement of said armature, said contactor having a generally hyperbolic magnetic pull characteristic plotting magnetic pull on said armature versus magnet gap between said armature and said core for a given excitation of said coil, the magnet gap between said armature and said core when said stationary and movable contacts engage being less than the magnet gap therebetween at the knee of said hyperbolic characteristic, said contact pressure spring being pre-loaded to a force greater than said magnetic pull on said armature at the knee of said characteristic.

2. A DC contactor in accordance with claim 1 wherein said contact pressure spring is pre-loaded to a force which is substantially greater than the force of said return spring means at the point of engagement of said movable and stationary contacts.

3. A DC contactor in accordance with claim 2 wherein said contact pressure spring is pre-loaded to a force greater than twice the force of said return spring means at the point where said contacts engage.

4. A DC contactor in accordance with claim 1 wherein the knee of said characteristic occurs approximately at the one-half armature travel position wherein said magnet gap is approximately one-half of the initial magnet gap between said armature and said core when said contact carrier bar engages said stop means, and said magnetic pull at the two-thirds armature travel position when said magnet gap is one-third of said initial gap is at least 150% of said magnetic pull at said knee.

5. A DC contactor in accordance with claim 4 wherein said magnetic pull at said two-thirds armature travel position when said magnet gap is one-third of said initial gap is equal to at least 200% of said magnetic pull at said knee.

6. A DC contactor in accordance with claim 4 wherein said movable and stationary contacts engage at a magnet gap which is less than one-third of said initial gap.

7. A DC contactor in accordance with claim 4 wherein all magnetic and resilient forces are exerted in the plane in which said armature moves, said stationary contact has a cylindrical surface with its axis in said plane and said movable contact has a cylindrical surface with the axis thereof transverse to said plane so that said cylindrical contact surfaces have point engagement in said plane, and including means for preventing said contact carrier bar from rocking about its longitudinal axis relative to said armature.

8. A DC contactor in accordance with claim 1 wherein said armature is of the clapper type and pivots in line engagement with said yoke, and including an armature retainer affixed to said yoke, and armature retainer spring means secured to said armature retainer and reacting against said armature to resiliently urge the pivoted end thereof in a direction toward line engagement with said yoke and also urge said armature in a direction toward said armature retainer, whereby pivoting of said armature tends to displace dirt accumulated in the pivot area and jamming of the armature is prevented.

* * * * *